United States Patent [19]

Willpütz

[11] Patent Number: 5,062,556

[45] Date of Patent: Nov. 5, 1991

[54] MOLDED PLASTIC GARMENT HANGER WITH INTEGRAL CLIPS

[75] Inventor: Wilhelm Willpütz, Köln, Fed. Rep. of Germany

[73] Assignee: W. Willpütz Kunststoffverarbeitungs GmbH, Köln, Fed. Rep. of Germany

[21] Appl. No.: 486,525

[22] Filed: Feb. 28, 1990

[30] Foreign Application Priority Data

Feb. 28, 1989 [DE] Fed. Rep. of Germany ... 8902362[U]

[51] Int. Cl.[5] ..... A47G 25/48; A47G 25/14

[52] U.S. Cl. ..... 223/96; 223/95; 223/91; 223/85; D6/315; D6/326

[58] Field of Search ..... 223/96, 95, 91, 93, 223/92, 88, 85; D6/315, 326

[56] References Cited

U.S. PATENT DOCUMENTS

| | | | |
|---|---|---|---|
| 4,623,079 | 11/1986 | Tendrup et al. | 223/93 X |
| 4,629,102 | 12/1986 | Tendrop et al. | 223/85 |
| 4,828,155 | 5/1989 | Louw | 223/93 X |
| 4,892,237 | 1/1990 | Duester et al. | 223/88 X |

FOREIGN PATENT DOCUMENTS

| | | | |
|---|---|---|---|
| 2120542 | 5/1983 | United Kingdom | 223/96 |
| 2136684 | 9/1984 | United Kingdom | 223/85 |

*Primary Examiner*—Werner H. Schroeder
*Assistant Examiner*—Bibhu Mohanty
*Attorney, Agent, or Firm*—Michael J. Striker

[57] ABSTRACT

A clothes hanger of a synthetic plastic material comprises a main part having a double-T-shaped cross-section and having a substantially vertical web wall, an upper wall and a lower flange. The main part has two ends, a clamp provided at each of the ends of the main part and including a substantially rigid abutment part and a tongue connected with the abutment part so that a gap is formed between the abutment part and the tongue for inserting an article of clothing to be clamped. A connection connects the abutment part with the tongue of one piece with one another and includes a substantially freely lying synthetic plastic ring shaped arc interrupted by the gap and connecting the abutment part with the tongue. The synthetic plastic arc has a cross-section which is greater than a cross-section of the upper flange and the lower flange. The tongue abuts against the abutment part with a prestress.

13 Claims, 1 Drawing Sheet

MOLDED PLASTIC GARMENT HANGER WITH INTEGRAL CLIPS

BACKGROUND OF THE INVENTION

The present invention relates to a clothes hanger composed of synthetic plastic material, especially polystyrene.

More particularly, it relates to such a synthetic plastic clothes hanger which has a double-T-shaped cross-section with a vertical web wall, an upper flange and a lower flange, and clamps provided at the end of the clothes hanger.

Clothes hangers of the above mentioned general type are known in the art. In known clothes hangers each clamp at the end of the hanger has a substantially rigid abutment part and a springy tongue connected of one piece with the abutment part so that a gap is formed between the abutment part and the tongue for easy insertion of an article of clothing to be clamped. Such clothes hangers are produced and distributed by the applicant for many years. In the known clothes hanger the springy tongue cooperating with the abutment part has only a small distance from the abutment part. Therefore, during an insertion of an article of clothing this distance is increased and thereby the article of clothing is clamped between the tongue and the abutment part. If however the article of clothing is relatively thin and relatively smooth, then it is not possible to suspend the article of clothing on the clothes hanger of the known construction in a simple and fast manner. For preventing the thickness increase of an underpants, the collars on the underpants are formed so thin that they cannot be held by the clamps of the known clothes hangers with a sufficient reliability.

SUMMARY OF THE INVENTION

Accordingly, it is an object of the present invention to provide a clothes hanger which avoids the disadvantages of the prior art.

More particularly, it is an object of the present invention to provide a clothes hanger which can reliably hold extremely thin articles of clothing by its clamps.

In keeping with these objects and with others which will become apparent hereinafter, one feature of the present invention resides, briefly stated, in a clothes hanger in which the tongue is connected with the abutment part through a substantially freely lying synthetic plastic ring shaped arc interrupted by the gap, the cross-section of the synthetic plastic arc is greater than the cross-section of the upper and lower flanges of the clothes hanger by at least 100%, and the tongue abuts against the abutment part with a prestress.

It has been shown that when the clothes hanger is designed in accordance with the present invention, the material accumulation in the synthetic plastic arc acts so that the synthetic plastic arc during cooling of the hot clothes hanger removed from the injection mold, presses the tongue with a prestress against the abutment part. This phenomenon results from the fact that the synthetic plastic arc on its outer periphery is cooled faster than inside, and due to the shrinkage occurring during cooling, the gap of the synthetic plastic ring required for the injection is narrower and provides the prestress of the tongue against a hump of the abutment part.

In accordance with another feature of the present invention, the clamps are arranged in the plane of the main part of the clothes hanger, and the gaps and the tongues of the clamps are directed downwardly and outwardly in a suspended position of the clothes hanger.

Still another feature of the present invention is that the synthetic plastic arc is held by the web wall having a thickness which is smaller by 1/5 of the thickness of the arc, and the web wall is arranged in the central plane of the arc and partially surrounds the latter.

In accordance with a further feature of the present invention, the lower flange forms an edge of the abutment part and merges into the synthetic plastic arc.

Still a further feature of the present invention is that the tongue is formed by an edge which corresponds to a cross-section of the lower flange and opens into the synthetic plastic arc, and this edge is provided with a reinforcing wall.

Finally, a shoulder projection is formed at a distance above the synthetic plastic arc and overlaps the latter. The shoulder projection merges into an additional tongue formed from the upper flange.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
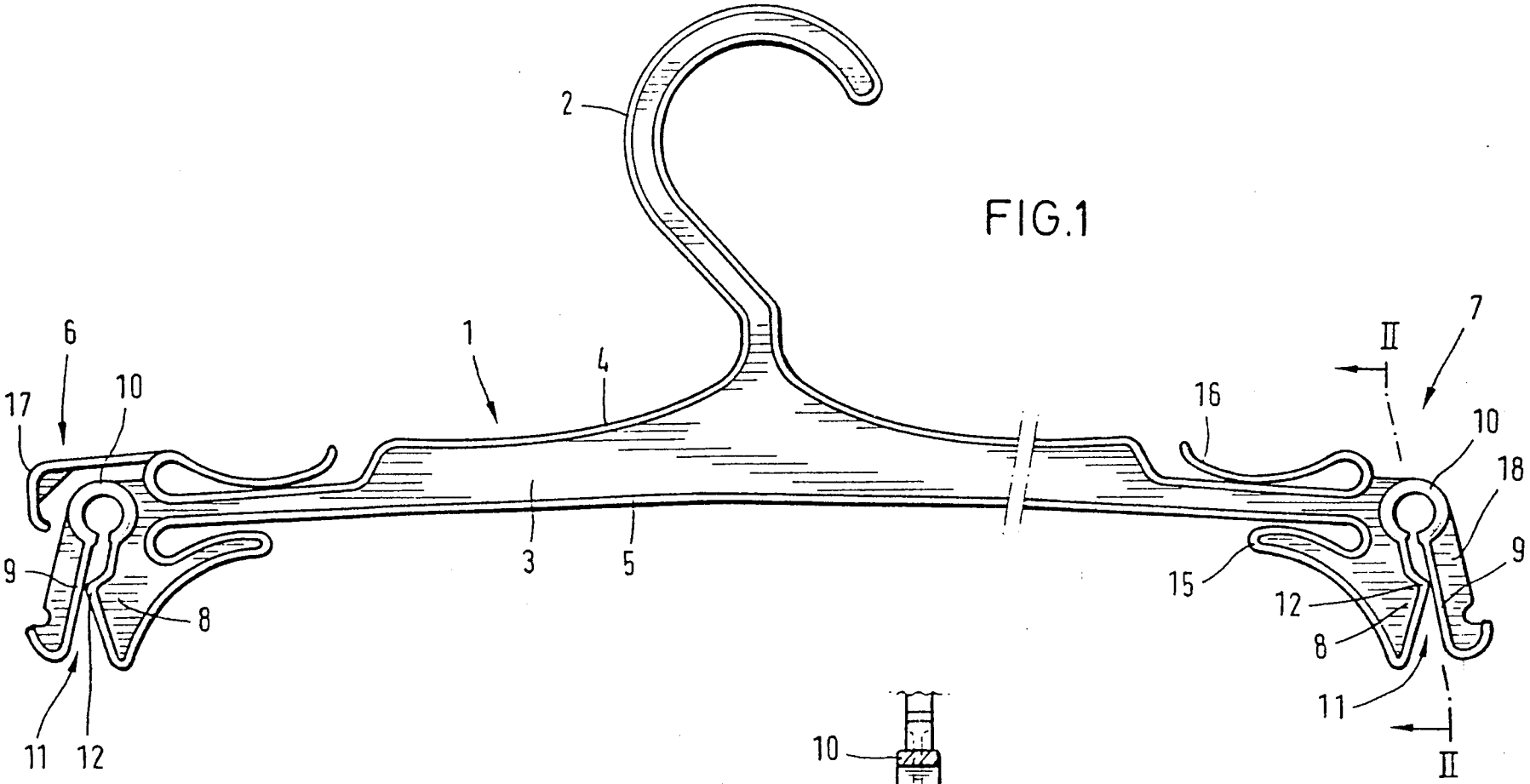
FIG. 1 is a view showing a clothes hanger in accordance with the present invention.
Figure 2:
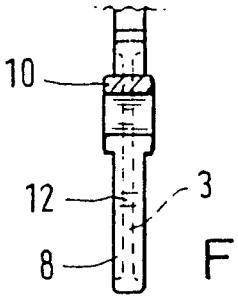
FIG. 2 is a view showing a section taken along the line II—II in FIG. 1.

A clothes hanger in accordance with the present invention has a double-T-shaped cross-section. It has a vertical web wall 3, and an upper flange 4 and a lower flange 5 having a width greater than the width of the web wall 3 so as to form the double T-shape. The ends of the clothes hanger are identified with reference numerals 6 and 7 and each provided with a clamp. Each clamp has a substantially rigid abutment part 8 and a tongue 9 formed of one piece with the abutment part 8. The tongue 9 contacts the abutment part 8 in the region of a hump 12. The gap 11 between the rigid abutment part 8 and the tongue 9 expands in a funnel-shaped manner for facilitating an insertion of an article of clothing to be clamped.

The tongue 9 is connected with the abutment part 8 through a substantially freely lying ring-shaped arc 10 which is interrupted by the gap 11. The arc 10 is composed of a synthetic plastic material. Its cross-section is greater than the cross-section of the upper flange 4 or the lower flange 5 by at least 100%, preferably by 200%.

Due to the material accumulation in the synthetic plastic arc 10, during hot removal of the clothes hanger from the injection mold the synthetic plastic arc 10 is cooled faster on the outer periphery than in the inner region. During cooling the produced shrinkage acts so that the tongue 9 is pressed against the hump 12 of the abutment part 8 with a prestress.

The gaps 11 of the clamps located at the ends of the hanger are directed downwardly and outwardly. Therefore for example a collar of underpants can be easily inserted in the gaps 11.

The clothes hanger can be additionally provided with further clamps in a known manner. For example, clamping tongues 15 can be provided at the lower side of the clothes hanger and tongues 16 can be provided on the upper side of the clothes hanger. In contrast to the tongues 9, the tongues 15 and 16 do not abut against the respective abutment with a prestress.

For making the new clothes hanger also suitable for hanging of shirts and the like, a shoulder projection 17 can be formed on the freely lying synthetic plastic arc 10 as shown in the left half of FIG. 1. The shoulder projection operates so that a shirt can be conveniently arranged on the clothes hanger. The shoulder projection 17 has a cross-section which is similarly to the tongue 16 substantially corresponds to the upper flange 4. The shoulder projection 17 is arranged substantially in alignment with the upper flange 4 and overlap the arc 10 at a distance therefrom.

The tongue 9 which abuts with a prestress is reinforced by a web wall 18, so that the spring action is produced solely from the synthetic plastic arc 10.

The prestress with which the tongue 9 abuts against the abutment part 8 increases with the increase in the thickness of the synthetic plastic arc 10 or with the increase of the difference between the inner diameter and the outer diameter of the synthetic plastic arc 10, and respectively with increase in the speed of cooling of the outer periphery of the synthetic plastic arc 10. This fast cooling is insured in that the arc 10 is substantially freely lying and is connected with a remaining portion of the clothes hanger 1 only by the relatively thin web wall 3. A part, especially $\frac{1}{3}$–$\frac{1}{4}$ of the synthetic plastic arc 10 is completely free. Therefore in this region the arc can be bent against the prestress, and as a result not very thin, but instead also relatively thick articles of clothing, such as the collar of the underpants and the like can be inserted in the gap 11.

The tongue 9 is reinforced by the reinforcing wall 18 which corresponds to the web wall 3. The abutment part 8 is bordered by the lower flange 5 and merges in the synthetic plastic arc 10.

It will be understood that each of the elements described above, or two or more together, may also find a useful application in other types of constructions differing from the types described above.

While the invention has been illustrated and described as embodied in a clothes hanger of a synthetic plastic material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A clothes hanger of a synthetic plastic material, comprising a main part a substantially vertical web wall, and an upper flange and a lower flange having a width greater than that of said web wall, said main part having two ends; a clamp provided at each of said ends of said main part and including a substantially rigid abutment part and a tongue connected with said abutment part so that a gap is formed between said abutment part and said tongue for inserting an article of clothing to be clamped; and means for connecting said abutment part and said tongue with one another and including a substantially freely lying synthetic plastic ring-shaped arc interrupted by said gap and connecting said abutment part with said tongue so that said tongue is pressed toward and abuts against said abutment part with a prestress under a springy action produced solely by said arc, said synthetic plastic arc having a width which is greater than a width of said upper flange and said lower flange and said clothes hanger further comprising a shoulder projection formed in alignment with said upper flange on said main part above said synthetic plastic arc overlapping said arc at a distance therefrom.

2. A clothes hanger as defined in claim 1, wherein said clothes hanger is composed of polystyrene.

3. A clothes hanger as defined in claim 1, wherein said clothes hanger is composed of an injection molded synthetic plastic material.

4. A clothes hanger as defined in claim 1, wherein said gap of each of said clamps expands downwardly in a funnel-shaped manner.

5. A clothes hanger as defined in claim 1, wherein the width of said synthetic plastic arc is greater than the width of said upper and lower flanges by at least 100%.

6. A clothes hanger as defined in claim 5, wherein said width of said synthetic plastic arc is greater than the width of said upper and lower flanges by 200%.

7. A clothes hanger as defined in claim 1, wherein said clamps are arranged in a plane of said main part, said gaps of said clamps facing downwardly and outwardly in a suspended condition of said clothes hanger.

8. A clothes hanger as defined in claim 1; and further comprising a hook arranged for suspending said clothes hanger in a substantially vertical position, said gaps facing downwardly and outwardly when said clothes hanger is suspended by said hook in said substantially vertical position.

9. A clothes hanger as defined in claim 1, wherein said synthetic plastic arc is supported by said web wall, said web wall having a thickness which is smaller than a thickness of said arc by substantially 1/5.

10. A clothes hanger as defined in claim 9, wherein said web wall is arranged in a central plane of said ring and only partially surrounds said arc.

11. A clothes hanger as defined in claim 1, wherein said lower flange forms an edge of said abutment part and merges into said synthetic plastic arc.

12. A clothes hanger as defined in claim 1, wherein said tongue is formed by an edge which has a cross-section corresponding to the cross-section of said lower flange and merges in said synthetic plastic arc, said tongue further including a wall which reinforces said edge.

13. A clothes hanger as defined in claim 1; and said shoulder projection merging into a second tongue.

* * * * *